United States Patent [19]

Tell

[11] 3,959,864

[45] June 1, 1976

[54] METHOD FOR PRODUCING AN EJECTOR DEVICE

[75] Inventor: Peter Hans Tell, Akersberga, Sweden

[73] Assignee: Aktiebolaget Piab, Akersberga, Sweden

[22] Filed: Nov. 25, 1974

[21] Appl. No.: 526,845

[30] Foreign Application Priority Data

Dec. 5, 1973 Sweden ..... 7316404

[52] U.S. Cl. ..... 29/156.4 R; 29/417; 29/DIG. 26; 29/DIG. 47; 417/174; 417/179; 264/150

[51] Int. Cl.[2] ..... B23P 15/00; F04F 5/46; F04F 5/22

[58] Field of Search ..... 29/156.4 R, 527.1, 417, 29/412, DIG. 26, DIG. 47; 417/174, 179; 264/150, 159, 162; 141/65, 7

[56] References Cited

UNITED STATES PATENTS

| | | | |
|---|---|---|---|
| 1,026,399 | 5/1912 | Koerting | 417/174 |
| 1,800,324 | 4/1931 | Shipley | 264/150 |
| 2,014,269 | 9/1935 | Barbour | 264/150 |
| 2,264,539 | 12/1941 | Lindstaedt | 137/604 |
| 2,309,666 | 2/1943 | Parker | 29/417 |
| 2,836,126 | 5/1958 | Ruth | 417/174 |
| 2,900,978 | 8/1959 | Johannisson | 417/174 |
| 3,274,315 | 9/1966 | Kawamura | 264/177 R |
| 3,350,757 | 11/1967 | Bowles | 264/150 |
| 3,587,156 | 6/1971 | Sorenson | 29/157.1 R |
| 3,659,325 | 5/1972 | Krehbiel et al. | 29/157.1 R |

FOREIGN PATENTS OR APPLICATIONS

| | | | |
|---|---|---|---|
| 882,783 | 6/1943 | France | 264/177 R |

*Primary Examiner*—C. W. Lanham
*Assistant Examiner*—Daniel C. Crane
*Attorney, Agent, or Firm*—Silverman & Cass, Ltd.

[57] ABSTRACT

Method for producing an ejector device including forming a profile rail, drilling holes in the rail to receive ejector nozzles therein and inserting the nozzles in the holes, closing the ends of the rail with end walls, and severing a desired length of the rail to produce the device.

7 Claims, 2 Drawing Figures

METHOD FOR PRODUCING AN EJECTOR DEVICE

BACKGROUND OF THE INVENTION

The present invention relates to a method for producing an ejector device with several ejectors, in which pressure air from one ejector is fed to a subsequent ejector and so on, whereby the ejector device has a large evacuation capacity in combination with a maximum negative pressure.

In known ejector devices of this kind each of the parts carrying the ejector nozzles is produced separately, machined and joined together to form an ejector housing with its channels. Consequently production of the parts of said ejector housing and the assembly thereof together simultaneously with positioning and fastening of the ejector nozzles, is difficult and time wasting.

SUMMARY OF THE INVENTION

It is an object of the present invention to provide a method for a considerably easier and faster production of an ejector device with several ejectors arranged in one or several groups.

The invention is characterized by a method for producing an ejector device with several ejectors including an ejector housing with an inlet channel for a pressure medium and one or several groups of ejector nozzles lying one after the other and suction channels connected to said nozzles, said suction channels being connected to a suction chamber directly or by valve means, said suction chamber communicating preferably with a container or the like to be evacuated, the method comprising the steps of producing a profile rail by forming of said inlet channel with preferably a circular cross section, forming said suction channels with substantially quadratic or rectangular cross sections, forming said suction chamber with substantially rectangular cross section and forming a communication opening between each suction channel and the suction chamber, said channels and chamber extending along the whole length of the profile rail, cutting off a required length of the profile rail to form said ejector housing in an ejector device, drilling holes or apertures along at least one straight line through the walls of the inlet and suctions channels, inserting ejector nozzles into said holes or apertures, said ejector nozzles lying one after the other along said straight line, inserting valve flaps to cover at least some of said communication openings in order to prevent backstreams from a suction channel to the suction chamber, and thereafter closing the ends of said inlet and suction channels and said suction chamber by fastening end walls to the ejector housing.

BRIEF DESCRIPTION OF THE DRAWING

The invention will be described in detail below in connection with a description of an embodiment shown on the attached drawing as an example and produced by the present method.

DESCRIPTION OF THE PREFERRED EMBODIMENT

Figure 1:
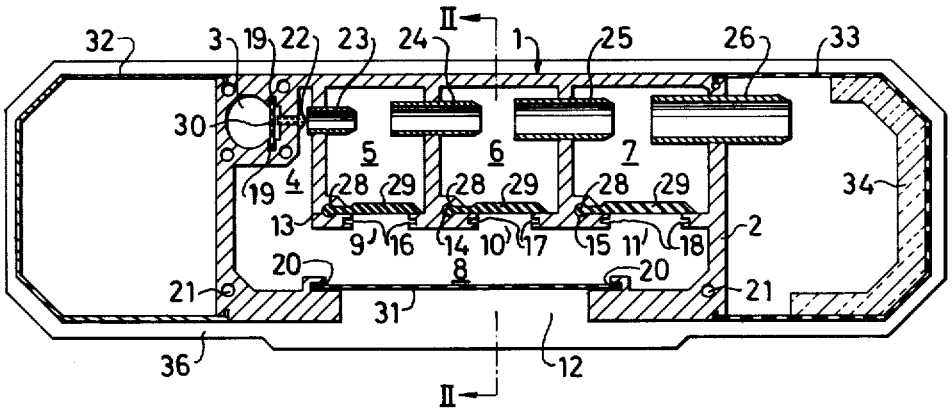
FIG. 1 shows a vertical section through an ejector device.

The ejector device shown on the drawing comprises an ejector housing 1 having the shape of a part of a profile rail, which is produced by moulding or extrusion of metal or plastic. In the production, the profile rail is provided with an outer wall 2, which has a rectangular cross section, and inside this wall and along the whole length of the profile rail there is an inlet channel 3 with a circular cross section for a pressure medium, preferably pressure air, two or more suction channels 4–7 with substantially quadratic or rectangular cross sections, a suction chamber 8 with substantially rectangular cross section, an elongate communication opening 9–11 bwtween each suction channel 5–7 and the suction chamber 8, and an inlet opening 12 to the suction chamber 8. Furthermore, in one of the housing walls near the communication openings 9–11 there are provided attachment slots 13–15 and in the edges facing each other of the openings 9–11 there are provided longitudinal grooves 16–18. Also in the inlet channel 3 and near the longitudinal edges of the inlet opening 12 there are provided grooves 19 and 20 respectively. Furthermore there are provided longitudinal holes 21 in the corners of the rectangular outer wall 2.

All details mentioned above are produced by metal or plastic moulding or extrusion of a long profile rail, from which suitable lengths thereafter are cut off to form ejector housings in ejector devices.

In such a cut off length of a profile rail holes or apertures are drilled along a straight line through the walls of the suction channels 4–7 and the inlet channels 3, said apertures or holes having a smaller diameter the closer to the inlet channel 3 they are situated, thereafter nozzles 22–26 are inserted and fixed by glueing for example in said apertures, as shown in FIG. 1. In the rail length, preferably several such groups of apertures or holes are drilled side by side with subsequent insertion of ejector nozzles therein. In the device according to the drawing, FIG. 2, there are provided seven groups of apertures and nozzles.

Filling members 27 are pressed into the grooves 16–18 at the ends of each communication opening. Said filling members 27 have the shape of rods, the lengths of which correspond to the widths between the edges of the communication openings 9–11. At their ends, the filling members are provided with short projections, which fit into the grooves 16, 17, 18, The purpose of each filling member 27 is to provide surfaces at the ends of each communication opening 9–11 against which the ends of valve flaps 29 can rest in order to provide a tight seal when the valve is closed.

Into each of the attachment slots 13–15 there is inserted a bead 28 of one of said valve flaps 29, which is formed by a profile list of rubber or the like, said valve flap having the same length as a communication opening. A filter 30 is inserted in the grooves 19 of the inlet channel 3 and a filter 31 is inserted in the grooves 20 of the inlet opening 12.

On that side of the ejector housing where the inlet channel 3 is situated, a casing 32 is arranged to form a space for automatic control devices and other things. On the opposite side of the ejector housing a casing 33 of metal fabric or perforated sheet is arranged, the inside of which is partly coated by a sound damping coating 34. Thereafter, the ends of the suction channels and the suction chamber are closed by end walls 35 and 36 which are fixedly located by screws in the holes 21. Said holes 21 can be threaded for receiving said screws or alternatively said screws can have the shape of long bolts which are inserted in said holes and provided with a head and a nut.

The inlet opening 12 is connected to the container or the like to be evacuated, and the inlet channel 3 is connected to a pressure air source, for example through one of the end walls.

Thereafter the described device is ready to operate in a way known per se. Thereby, when pressure air is pressed into the inlet channel 3, the air will stream out through the nozzle 22 and will bring with it air from the suction channel 4 and thereby from the suction chamber 8, so that the initial pressure air together with the air brought with it will stream out through the nozzle 23 and so on. Thus the pressure air quantity will increase through the nozzles from ejector to ejector. The one-way valves 29 are closed when the pressure in one of the suction channels 5, 6 or 7, where said valves are located, exceeds the pressure in the common suction chamber 8, and by this means an optimal efficiency degree may be obtained for each value of resistance to the air stream that may prevail in any of the suction channels or in the channel system that may be connected to the suction chamber.

By choosing the thickness and/or the flexibility of the different valve flaps, the different valves in an ejector may be adapted to close for different values of the air pressure in the suction channel. In that way the operation of the ejector can be more smoothly controlled, which means that the suction power smoothly follows the quantity and pressure of the air supplied to the inlet channel 3.

The method according to the present invention has the advantage that it very much facilitates the production of ejectors of the kind described. Further, said method makes it possible to choose the number of ejector nozzles lying after each other in each single group. Still further, the number of such groups of ejector nozzles may be chosen according to desire. By a suitable choice of the number of nozzles in each group and the number of groups the ejector can be adapted to the prevailing requirements of ejector capacity in respect of the desired degree of evacuation and the quantity of gas per time unit that should be evacuated.

Figure 2:
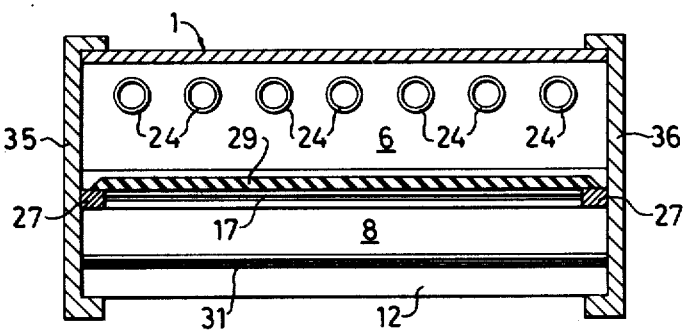
FIG. 2 shows a vertical section perpendicular to said vertical section of FIG. 1 and taken along the line II—II in FIG. 1.

In the embodiment shown in the drawing the pressure air streaming out of the nozzle 26 is let out through the perforated casing 33 to the open air. Alternatively this air can be collected, for example by the casing 33 being replaced by a tight casing having an outlet, from which outlet air can stream to for example a combustion plant or some other device requiring air. In this case a valve can be arranged also in the suction channel 4. The inlet opening can still be connected to a container, if a certain medium, for example gas, is to be removed from the container, or it can be open to the open air, as is shown in FIG. 2.

The shape of the profile rail according to the invention can of course vary within the scope of the invention. For example channels and grooves for valve means and filters may be deleted, and some other method for attaching said details can be provided.

We claim:

1. A method for producing an ejector device having a plurality of ejectors comprising, A. forming in one step a generally tubular profile rail with i. a substantially planar top wall, ii. first and second side walls, iii. a bottom wall with an inlet opening along the length thereof, iv. an inlet channel in a corner between the top wall and the first side wall, v. spaced intermediate walls disposed parallel to said side walls, the intermediate walls projecting from the top wall and having respective free ends terminating a short distance from said bottom wall, and vi. suction openings between said free ends and the second side wall, B. drilling holes in the formed rail along at least one straight line through said second side wall, said intermediate walls and a wall of the inlet channel, C. inserting ejector nozzles in said drilled holes, the nozzles having respectively increasing widths progressing from the nozzle inserted in the inlet channel, D. inserting a respective flap valve in each said suction opening, the flap valves being operable as non-return valves, and E. closing the ends of the rail by attaching an end wall to each end of the formed rail.

2. A method as claimed in claim 1 in which said step of forming is performed by extruding the device.

3. A method as claimed in claim 1 including the step of severing a desired length of the rail after the step of closing.

4. A method as claimed in claim 1 in which the rail is formed of metal.

5. A method as claimed in claim 1 in which said suction openings are formed with attachment slots for receipt of a bead of a respective flap valve, said suction openings being further formed with grooves along respective edges thereof for receipt of filling members therein, said rail being formed with holes for receipt of fasteners to secure the end walls thereto, said slots, grooves and holes being formed along the entire length of said rail.

6. A method as claimed in claim 1 in which said inlet channel is formed with grooves in the longitudinal direction thereof and said inlet opening is formed with grooves in oppositely facing edges thereof, and a respective filter is positioned in the inlet channel grooves and the inlet opening grooves before the step of closing.

7. A method as claimed in claim 5 in which said inlet channel is formed with grooves in the longitudinal direction thereof and said inlet opening is formed with grooves in oppositely facing edges thereof, and a respective filter is positioned in the inlet channel grooves and the inlet opening grooves before the step of closing.

* * * * *